US012551938B2

(12) United States Patent
Matschullat et al.

(10) Patent No.: US 12,551,938 B2
(45) Date of Patent: Feb. 17, 2026

(54) COOLING DEVICE WITH COOLANT JETS HAVING A HOLLOW CROSS SECTION

(71) Applicant: Primetals Technologies Germany GmbH, Erlangen (DE)

(72) Inventors: Thomas Matschullat, Eckental (DE); Klaus Weinzierl, Nuremberg (DE)

(73) Assignee: Primetals Technologies Germany GmbH (DE)

( * ) Notice: Subject to any disclaimer, the term of this patent is extended or adjusted under 35 U.S.C. 154(b) by 989 days.

(21) Appl. No.: 17/766,686

(22) PCT Filed: Oct. 14, 2020

(86) PCT No.: PCT/EP2020/078917
§ 371 (c)(1),
(2) Date: Apr. 5, 2022

(87) PCT Pub. No.: WO2021/074233
PCT Pub. Date: Apr. 22, 2021

(65) Prior Publication Data

US 2024/0075511 A1 Mar. 7, 2024

(30) Foreign Application Priority Data

Oct. 16, 2019 (EP) ..... 19203498

(51) Int. Cl.
*B21B 45/02* (2006.01)
*B21B 1/22* (2006.01)
*B21B 1/26* (2006.01)

(52) U.S. Cl.
CPC ..... *B21B 45/0233* (2013.01); *B21B 1/26* (2013.01); *B21B 45/0218* (2013.01); *B21B 2001/225* (2013.01)

(58) Field of Classification Search
CPC ..... B21B 37/44; B21B 37/74; B21B 45/02; B21B 45/0203; B21B 45/0218; B21B 45/0209; B21B 45/0233
See application file for complete search history.

(56) References Cited

U.S. PATENT DOCUMENTS 5,873,949 A 2/1999 Tamm et al. ..... 134/64 R
9,314,827 B2 * 4/2016 Atalla ..... B21B 27/06
(Continued)

FOREIGN PATENT DOCUMENTS

CN 1140425 A 1/1997
CN 1586755 A 3/2005
(Continued)

OTHER PUBLICATIONS

Notification to Grant Patent Right for Invention dated Jul. 23, 2024 issued in corresponding Chinese Patent Application No. 202080072166.8. English translation attached.
(Continued)

*Primary Examiner* — Teresa M Ekiert
(74) *Attorney, Agent, or Firm* — OSTROLENK FABER LLP

(57) ABSTRACT

The invention relates to a cooling device with coolant jets having a hollow cross section. A treatment line for a flat, elongate, hot rolling stock made of metal has a finishing train for rolling the rolling stock and a cooling device. The cooling device can, as required, be located upstream or downstream of the finishing train or within the finishing train. The cooling device has a first cooling bar, which extends fully over the rolling stock, seen in the width direction of the rolling stock. The first cooling bar has, facing the rolling stock, several coolant outlets by means of which water is applied to the rolling stock. The coolant outlets are arranged in the first coolant bar in a positionally fixed manner extending in at least one width direction (y) of
(Continued)

the rolling stock and each have, within the respective row, a predefined distance from one another.

18 Claims, 6 Drawing Sheets

(56) References Cited

U.S. PATENT DOCUMENTS

| | | | |
|---|---|---|---|
| 10,130,980 | B2 | 11/2018 | Duhoux et al. |
| 11,338,340 | B2 | 5/2022 | Freliez |
| 2015/0239027 | A1 | 8/2015 | Alken et al. |
| 2017/0189949 | A1 | 7/2017 | Duhoux et al. |
| 2020/0036096 | A1 | 1/2020 | Kurokawa |
| 2020/0047230 | A1 | 2/2020 | Opitz et al. |

FOREIGN PATENT DOCUMENTS

| | | | |
|---|---|---|---|
| CN | 102859009 | A | 1/2013 |
| CN | 106661648 | A | 5/2017 |
| CN | 109789454 | A | 5/2019 |
| DE | 102017127470 | A1 | 5/2019 |
| EP | 2789405 | A1 | 10/2014 |
| EP | 3395463 | A1 | 10/2018 |
| KR | 10-2014-0005461 | A | 1/2014 |
| KR | 101394447 | B1 | 5/2014 |
| WO | WO 0110042 | A1 | 2/2001 |

OTHER PUBLICATIONS

Office Action dated Mar. 23, 2024 issued in corresponding Chinese Patent Application No. 202080072166.8. English translation of CN Search Report.

International Search Report mailed Dec. 8, 2020 in corresponding PCT International Application No. PCT/EP2020/078917.

Written Opinion mailed Dec. 8, 2020 in corresponding PCT International Application No. PCT/EP2020/078917.

Search Report mailed Apr. 3, 2020 in corresponding European Patent Application No. 19203498.1.

Ian Stewart et al.: "Heat transfer coefficient effects on spray cooling"; Aise Steel Technology, Aise, Pittsburg; PA; US; Bd. 73; Nr. 7; Jul. 1, 1996, pp. 17-23; XP000630104, ISSN 0021-1559; 1996.

* cited by examiner

COOLING DEVICE WITH COOLANT JETS HAVING A HOLLOW CROSS SECTION

CROSS-REFERENCE TO RELATED APPLICATIONS

The present application is a 35 U.S.C. §§ 371 national phase conversion of PCT/EP2020/078917, filed Oct. 14, 2020, the contents of which are incorporated herein by reference, which claims priority of European Patent Application No. 19203498.1 filed Oct. 16, 2019, the contents of which are incorporated by reference herein. The PCT International Application was published in the German language.

TECHNICAL FIELD

The present invention is based on a treatment line for a flat, elongate hot metal rolling stock,

- wherein the treatment line comprises a finishing train for rolling the rolling stock,
- wherein the treatment line comprises a cooling device,
- wherein the cooling device is arranged upstream of the finishing train, is arranged downstream of the finishing train or is arranged within the finishing train,
- wherein the cooling device comprises a first cooling bar which extends, as seen in a width direction of the rolling stock, completely over the rolling stock,
- wherein the first cooling bar comprises a plurality of first coolant outlets facing the rolling stock, by means of which water is applied to the rolling stock,
- wherein the first coolant outlets are arranged in the first cooling bar so as to be positionally fixed in at least one row extending in the width direction of the rolling stock, and have, within the respective row, as seen in the width direction of the rolling stock, a respective predetermined spacing from one another,
- wherein the first coolant outlets are in the form of full-jet nozzles, from which a full jet having a respective intrinsically continuous cross section exits during operation,
- wherein a jet opening angle of the full jet exiting from the full-jet nozzles is at most 5°,
- wherein the cross sections of the full jets each have a convex envelope.

In the context of the present invention, the term "metal" is firstly intended to comprise elementary metals such as for example aluminum or copper. However, the term "metal" is also secondly intended to encompass customary metal alloys. By way of example, the rolling stock may be composed in particular of steel, aluminum or an aluminum alloy, or even of brass in individual cases. The flat, elongate rolling stock may alternatively be in the form of a strip or in the form of a plate.

In the finishing train, the rolling stock is rolled from a starting thickness to a final thickness. The finishing train usually comprises a plurality of rolling stands which are arranged in succession so that the rolling stock passes through them with a uniform transport direction. In individual cases, however, it is also possible for reversing rolling to be carried out. In the subsequent cooling section, the rolling stock is cooled to a target temperature. Attempts are often made to set a predefined temporal temperature profile in an exact manner. Furthermore, a cooling device may be arranged upstream of the finishing train in order to be able to set the temperature of a strip which is running into the finishing train and which has not yet been rolled. It is also possible for so-called intermediate stand cooling systems to be arranged between the rolling stands of the finishing train.

PRIOR ART

Treatment lines of this kind are generally known. In particular, a cooling section is usually arranged downstream of hot rolling mills—whether they be in the form of isolated rolling trains or in the form of casting-rolling installations. Depending on the circumstances of the individual case, the cooling section may be in the form of a laminar cooling section and/or in the form of a cooling system with a so-called water curtain and/or in the form of a spray water cooling system and/or in the form of an intensive cooling system. The same applies to cooling devices upstream of the finishing train or within the finishing train. In all cases, water is applied to the rolling stock to be cooled over the width of the rolling stock to be cooled.

With the exception of the configuration as a so-called water curtain (here a single "nozzle" is present which extends over the entire width of the rolling stock), the first cooling bar comprises a number of coolant outlets which are arranged, as seen in the width direction of the rolling stock, at a predetermined spacing from one another, usually in a fixed pattern of 5 cm, for example. The water is applied to the flat rolling stock from above or from below by means of the first cooling bar. At least in the case of a cooling section which is arranged downstream of the finishing train, a plurality of cooling bars are in each case arranged both above and below the rolling stock as seen in a transport direction of the flat rolling stock.

The coolant outlets may be configured in various ways.

For example, configuration in the form of spraying nozzles is known, often also referred to as fan nozzles. Fan nozzles apply the water to the flat rolling stock in a jet, which, as viewed from the respective spraying nozzle, has a significant opening angle, often 50° and more, at least in one direction. When using fan nozzles, there is often a considerably non-uniform cooling action as seen over the width of the flat rolling stock.

Configuration in the form of spray nozzles is furthermore also known. Spray nozzles atomize the water. They therefore have a relatively low cooling action. In addition, this cooling action is also not uniform as seen over the width of the flat rolling stock.

Usually, the coolant outlets are in the form of full-jet nozzles. This applies both in the case of a configuration of the cooling device as a cooling device with laminar operation and in the case of a configuration of the cooling device as an intensive cooling system. In the case of full-jet nozzles, the water exits from the respective full-jet nozzle in the form of a compact jet (referred to as full jet or impact jet). The full jet has only a small opening angle, if any. Full-jet nozzles are thus nozzles from which the water exits in a jet which does not widen or at least only slightly widens. A jet opening angle comprised by the water jet exiting from the respective full-jet nozzle is generally at most 5°, often only 3° or only 2° or even a still lower value.

In the case of full-jet nozzles, the cooling of the flat rolling stock in the region in which the jets impinge on the flat rolling stock is also greater than in the regions in between. There is thus also non-uniform cooling of the strip when using full-jet nozzles. However, in the overall evaluation, full-jet nozzles have—compared with the other types of nozzle—the most advantages and the fewest disadvantages. Full-jet nozzles are therefore generally used in cooling devices.

The material properties of the flat rolling stock are influenced to a considerable extent by the temporal profile of the cooling in the cooling device, in particular in a cooling section arranged downstream of the finishing train. If the cooling is not uniform as seen over the width of the rolling stock, this also yields non-uniform material properties. In some cases, these fluctuations may be tolerated. In other cases, they have a disruptive effect. Furthermore, the non-uniform cooling may also give rise to flatness errors.

Within cooling sections (that is to say cooling devices that are arranged downstream of the finishing train), attempts are usually made to minimize the problems in that the coolant outlets of successive cooling bars in the transport direction of the rolling stock or the coolant outlets of the various rows of coolant outlets within a respective cooling bar are offset in relation to one another. In particular, if there is in each case only one row of coolant outlets per cooling bar, it is for example possible for the coolant outlets of a certain cooling bar to each be arranged, as seen in the width direction of the flat rolling stock, centrally between the coolant outlets of the cooling bar that is arranged immediately upstream of the cooling bar in question as seen in the transport direction of the flat rolling stock. In this way, the problems of the prior art can indeed be reduced, but not eliminated.

KR 101 394 447 B1 has disclosed a treatment line for a flat, elongate hot metal rolling stock, said treatment line comprising a roughing train and a finishing train for the purpose of rolling the rolling stock. A cooling section is arranged between the roughing train and the finishing train. The cooling section comprises an individual cooling bar which extends, as seen in the width direction of the rolling stock, completely over the rolling stock. The cooling bar may comprise a plurality of application devices facing the rolling stock, which, for their part, each comprise a plurality of coolant outlets. The application devices can be positioned independently of one another as seen in the width direction of the rolling stock. Furthermore, prior to the cooling of the hot rolling stock, it is possible to select which of the respective coolant outlets for each application device are to be used to apply water to the rolling stock. The coolant outlets have various nozzle forms. One of the nozzle forms comprises a strip which runs around in the manner of the edges of a rectangle.

SUMMARY OF THE INVENTION

The object of the present invention is to provide possible ways in which improved cooling of the flat rolling stock can be achieved after rolling in the finishing train.

The object is achieved by a treatment line having the claimed features.

According to the invention, a treatment line of the type mentioned in the introduction is designed such that the respective convex envelope contains at least one region which is not contained in the respective full jet itself.

This makes it possible to achieve a situation where the way in which the water is applied to the flat rolling stock—namely in the form of a full jet—can be retained, but the water can be applied over a greater region, in particular as seen in the width direction of the rolling stock. This makes it possible to homogenize the cooling.

It is possible for the first cooling bar to be in the form of an intensive cooling bar. In this case, the water exits from the first coolant outlets of the first cooling bar with a pressure of at least 1 bar, in particular with a pressure of between 1.5 bar and 4 bar. Alternatively, it is possible for the first cooling bar to be in the form of a laminar cooling bar. In this case, the water exits from the first coolant outlets of the first cooling bar with a pressure of at most 0.5 bar, in particular with a pressure of between 0.1 bar and 0.4 bar.

It is possible for the cross sections of the full jets to each be closed in an annular manner. In this case, cross sections of the full jets thus in each case surround a region which is enclosed, as seen in the cross-sectional plane, completely by the cross section of the respective full jet. Although this region is a constituent part of the convex envelope of the respective full jet, it is not a constituent part of the cross section of the respective full jet itself. Alternatively, it is possible for the cross sections of the full jets to each be in the form of part of a respective circular ring. The respective circular ring may extend in particular over a respective angle of at least 90° and at most 270°, usually approximately 150° to 210°.

Alternatively, it is possible for the cross sections of the full jets to each be of V-shaped or zigzag-shaped form. Zigzag shapes are for example an N shape or a W shape. The fewer bending points the cross section has, the more favourably the respective shape is formed.

The respective convex envelope has, as seen in the cross-sectional plane, a maximum extent. The respective cross section has, as seen in the cross-sectional plane, a maximum effective width. The ratio of the maximum extent to the maximum effective width is preferably greater than 3:1, in particular greater than 5:1.

In many cases, the cooling device comprises at least one second cooling bar—in addition to the first cooling bar. This is generally the case in particular for cooling devices arranged downstream of the finishing train (i.e. for a cooling section). In this case, just like the first cooling bar, the second cooling bars extend, as seen in the width direction of the rolling stock, completely over the rolling stock. Just like the first cooling bar, they also each have a plurality of coolant outlets facing the rolling stock, by means of which water is applied to the rolling stock. The second coolant outlets are arranged in the second cooling bar so as to be positionally fixed in at least one row extending in the width direction of the rolling stock. Within the respective row, the second coolant outlets have a respective predetermined spacing from one another. However, the second cooling bars are arranged, as seen in the transport direction of the rolling stock, downstream of the first cooling bar. Thus, the rolling stock is firstly cooled by means of the first cooling bar, and then by means of the second cooling bars.

The second coolant outlets of at least one of the second cooling bars are preferably arranged, as seen in the width direction of the rolling stock, between the coolant outlets of the first cooling bar. As a result, any remaining irregularities in the cooling can be readily compensated by means of the first cooling bar. This second cooling bar may in particular be the cooling bar that is arranged immediately downstream of the first cooling bar as seen in the transport direction of the rolling stock.

It is possible for the second coolant outlets of at least one of the second cooling bars to be in the form of full-jet nozzles, from which a full jet having a respective cross section exits during operation. In this case, the cross sections of these full jets may each have a convex envelope, and this respective convex envelope may furthermore contain at least one region which is not contained in the respective full jet itself. This makes it possible to achieve the same advantages regarding the corresponding second cooling bar as regarding the first cooling bar.

Alternatively, it is possible for the second coolant outlets of at least one of the second cooling bars to be in the form of full-jet nozzles, from which a full jet having a respective cross section exits during operation, wherein the cross sections of these full jets do indeed each have a convex envelope, but this respective convex envelope corresponds to the cross section of the respective full jet. In this case, the full-jet nozzles of the corresponding second cooling bar are configured in a conventional manner.

Equally, it is also possible for the second coolant outlets of at least one of the second cooling bars to be in the form of fan nozzles or spray nozzles.

The object according to the invention is likewise achieved by a method for finish-rolling and cooling a flat, elongate metal rolling stock in a treatment line as claimed in claim 13, wherein the rolling stock is hot-rolled in the finishing train of the treatment line, and the at least partially hot-rolled rolling stock is cooled in a cooling device of the treatment line, wherein water is used to cool the rolling stock, in the width direction thereof, by way of a plurality of full jets, wherein a plurality of, preferably all, full jets contain a respective convex envelope comprising at least one region which is not contained in the respective full jet itself.

According to one embodiment, the rolling stock is wound up into a coil after cooling.

BRIEF DESCRIPTION OF THE DRAWINGS

The characteristics, features and advantages of this invention that are described above and the manner in which they are achieved will become clearer and more distinctly comprehensible in connection with the description of the exemplary embodiments that follows, said exemplary embodiments being explained in more detail in conjunction with the drawings, in which, in a schematic illustration.

DESCRIPTION OF THE EMBODIMENTS

Figure 1:
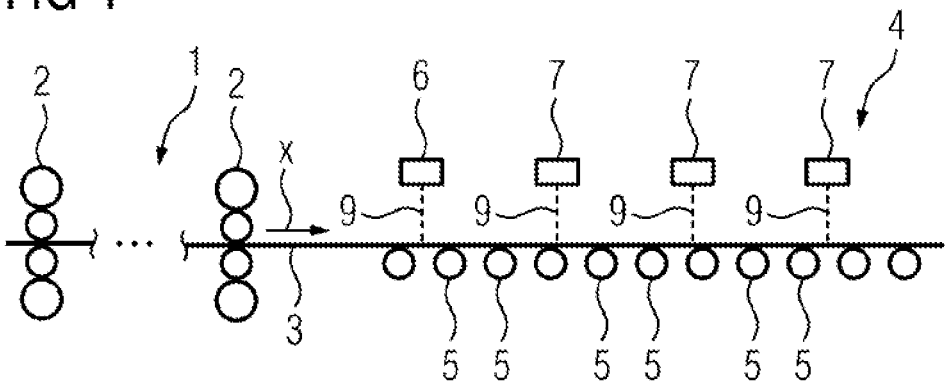
FIG. 1 shows a treatment line for a flat, elongate hot rolling stock from the side.
Figure 2:
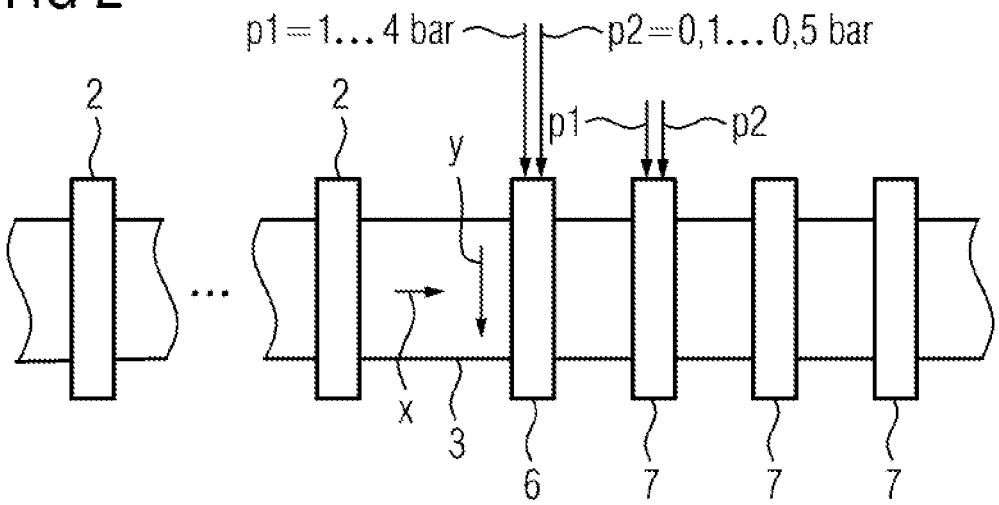
FIG. 2 shows the treatment line of FIG. 1 from above.

As per FIGS. 1 and 2, a treatment line comprises a finishing train 1. As a rule, the finishing train 1 comprises a plurality of rolling stands 2, often between three and seven rolling stands 2, in particular four or six rolling stands 2, for example five rolling stands 2. Only the first and the last rolling stand 2 of the finishing train 1 are illustrated in FIGS. 1 and 2. The rolling stands 2 are generally arranged in succession so that a flat, elongate hot metal rolling stock 3 passes through them in a uniform transport direction x. In individual cases, however, it is also possible for reversing rolling to be carried out. The rolling stock 2 may be composed of steel or aluminum, for example. It may alternatively be a strip or a plate.

In the finishing train 1, the rolling stock 3 is rolled from a starting thickness to a final thickness. The rolling stock 3 thus runs into the first rolling stand 2 of the finishing train 1 with the starting thickness, and runs out of the last rolling stand 2 of the finishing train 1 with the final thickness. When running out of the last rolling stand 2 of the finishing train 1, the rolling stock 3 has a final rolling temperature. In the case of steel rolling stock 3, the final rolling temperature may be between 750° C. and 1000° C., for example.

Most of the components of the treatment line that are arranged upstream of the finishing train 1 are of subordinate importance in the context of the present invention. For example, a continuous casting installation may be arranged upstream of the finishing train 1. A roughing train or a roughing stand may be arranged between the finishing train 1 and the continuous casting installation, as required. It is also possible for a furnace to be arranged upstream of the finishing train 1, a roughed strip being heated to rolling temperature in said furnace. Other configurations are also possible.

The treatment line furthermore comprises a cooling device 4. In the present case, the cooling device 4 is in the form of a cooling section which is arranged downstream of the finishing train 1. In the cooling section, the rolling stock 3 is cooled from the final rolling temperature to a target temperature. In the case of steel rolling stock 3, the target temperature may be between 150° C. and 800° C., for example. Attempts are often made to set a predefined temporal temperature profile in an exact manner. As an alternative to an arrangement downstream of the finishing train 1, the cooling device 4 could also be arranged within the finishing train 1, that is to say in the form of an intermediate stand cooling system which is arranged between in each case two rolling stands 2 of the finishing train. As an alternative to an arrangement downstream of the finishing train 1 or within the finishing train 1, the cooling device 4 could also be arranged upstream of the finishing train 1, for example could be in the form of a roughed strip cooling system between a roughing train or a roughing stand and the finishing train 1.

In the case of a strip, it is for example possible for a coiler to be arranged downstream of the cooling section. In the case of a plate, a stacker may be arranged downstream of the cooling section. The devices arranged downstream of the cooling section are of subordinate importance and do not form part of the subject matter of the present invention.

The cooling section comprises rollers 5, by means of which the rolling stock 3 is conveyed in the transport direction x through the cooling section. The rollers 5 are illustrated only in FIG. 1. In FIG. 1, again, only some of the rollers 5 have been denoted by their reference designations. However, the rollers 5 as such are of subordinate importance in the context of the present invention and are therefore not discussed in any more detail.

In order to cool the rolling stock 3, the cooling device 4 comprises a first cooling bar 6. As per FIG. 2, the first cooling bar 6 extends, as seen in the width direction y of the rolling stock 3, completely over the rolling stock 3. This applies regardless of the specific width of the rolling stock 3. The first cooling bar 6 is thus dimensioned in such a way that it completely covers the rolling stock 3, as seen in the width direction y, even if the rolling stock 3 has the maximum possible width in relation to the treatment line. Furthermore, at least in the case of a cooling section, not only is the first cooling bar 6 present, but the cooling device 4 additionally also comprises a number of second cooling bars 7. The second cooling bars 7 also extend, as seen in the width direction y of the rolling stock 3, completely over the rolling stock 3.

In accordance with the illustration in FIGS. 1 and 2, the present invention is explained with a first cooling bar 6 and also second cooling bars 7 which are all arranged above the rolling stock 3 (and above the rollers 5). Alternatively, the cooling bars 6, 7 could all be arranged below the rolling stock 3 (and below the rollers 5). The corresponding statements concerning the arrangement and configuration of the cooling bars with respect to the cooling bars 6, 7 still apply in unchanged form in this case. It is also possible for cooling bars 6, 7 to be arranged both above and below the rolling stock 3. In this case, the corresponding statements concerning the arrangement and configuration of the cooling bars 6, 7 apply independently of one another to the cooling bars 6, 7 arranged above the rolling stock 3 on the one hand and the cooling bars 6, 7 arranged below the rolling stock 3 on the other hand.

Figure 3:
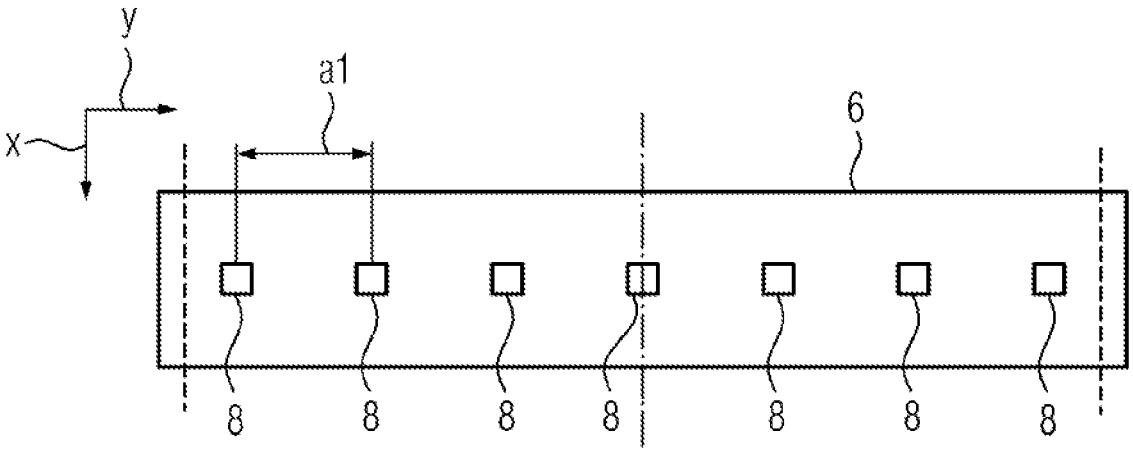
FIG. 3 shows that side of a first cooling bar which faces the rolling stock.

In accordance with the illustration in FIG. 3, the first cooling bar 5 comprises a plurality of coolant outlets 8 facing the rolling stock 3. Water 9 (see FIGS. 1 and 4) is applied to the rolling stock 3 by means of the coolant outlets 8. In accordance with the illustration in FIG. 3, the coolant outlets 8 are arranged in the first cooling bar 6 in a positionally fixed manner. The coolant outlets 8 may be arranged in one row or in multiple rows, as required. Within the respective row, the coolant outlets 8 have a respective predetermined spacing a1 from one another as seen in the width direction y of the rolling stock 3. The spacing may be in the range of a few cm, for example 4 cm to 8 cm. Overall, the coolant outlets 8 likewise extend over the entire width of the rolling stock 3. The side edges of a rolling stock 3 with a maximum possible width are illustrated by dashed lines in FIG. 3. Furthermore, the center line of the roller table defined by the rollers 5 is illustrated by a dashed-and-dotted line.

The coolant outlets 8 of the first cooling bar 6 are generally of uniform design. Therefore, only one of the coolant outlets 8 is explained in more detail below in conjunction with FIGS. 4 and 5. However, the corresponding statements also apply to the other coolant outlets 8 of the first cooling bar 6.

Figure 4:
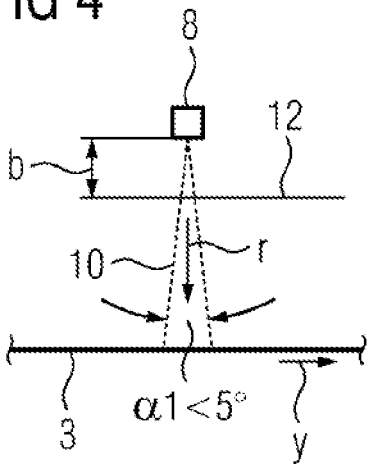
FIG. 4 shows a coolant outlet and a full jet.

In accordance with the illustration in FIG. 4, the coolant outlet 8 is in the form of a full-jet nozzle. A full jet 10 thus exits from the full-jet nozzle during operation. A full jet 10 and, correspondingly, a full-jet nozzle are characterized in that the full jet 10 does not widen or at least only slightly widens. A jet opening angle $\alpha 1$ comprised by the full jet 10 is generally at most 5°, often only 3° or only 2° or even a still lower value. Ideally, the jet opening angle $\alpha 1$ is 0° or as close to 0° as possible.

Figure 5:
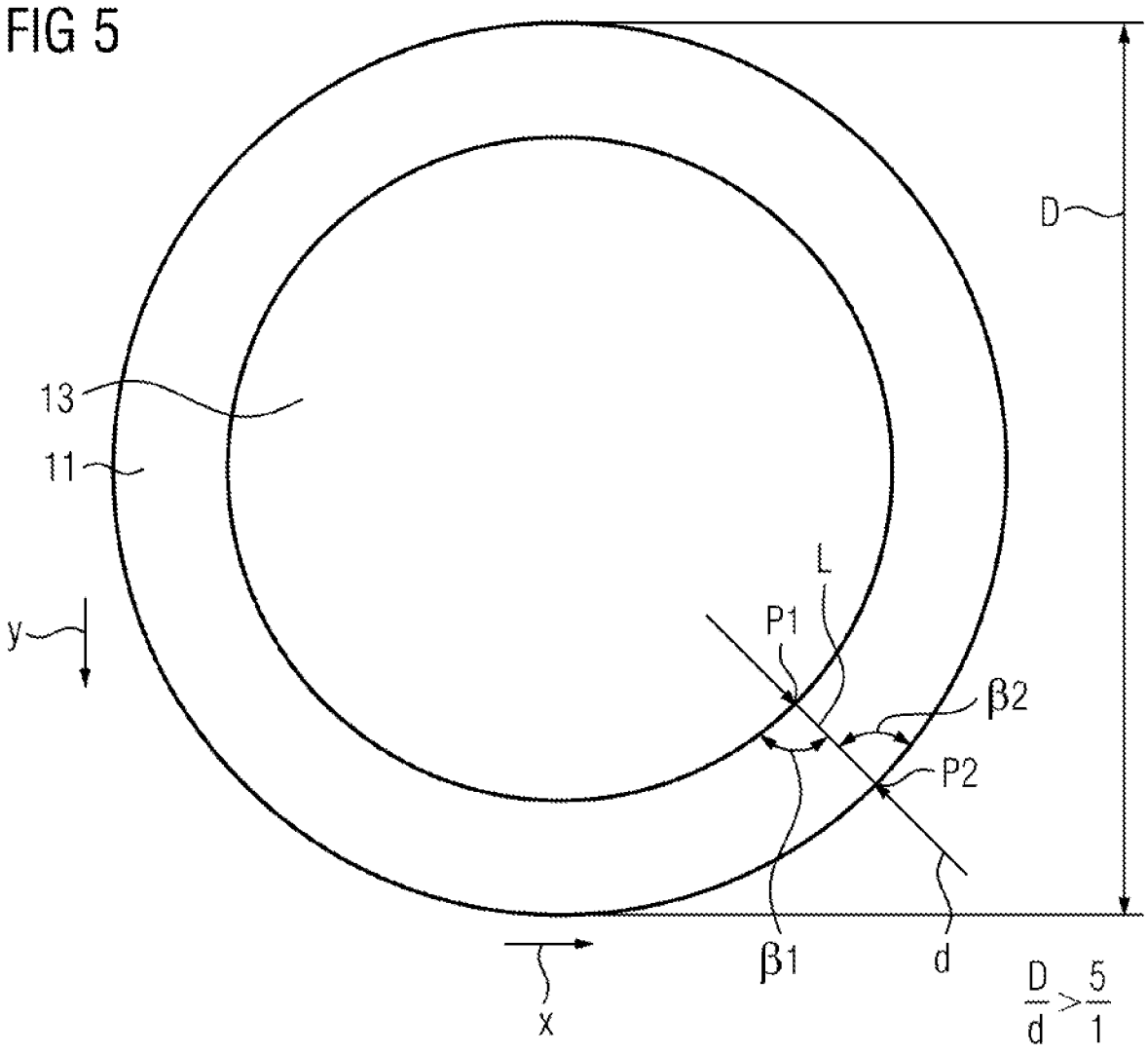
FIG. 5 shows the full jet of FIG. 4 in cross section.
Figure 6:
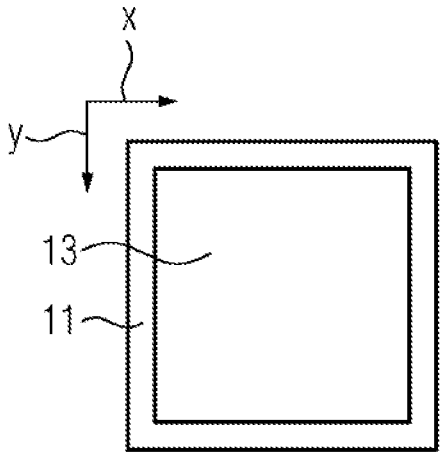
FIGS. 6 to 13 show alternative cross sections to FIG. 5.
Figure 7:
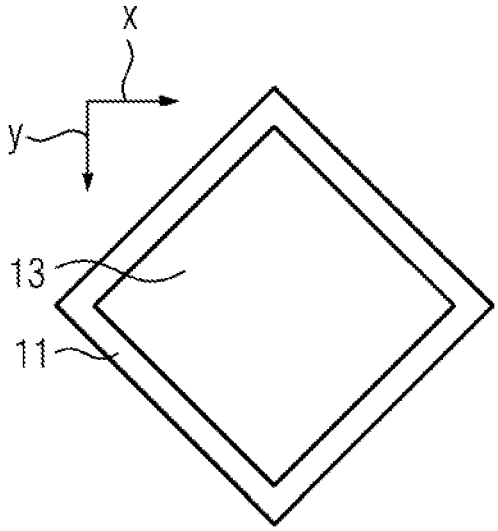
Figure 8:
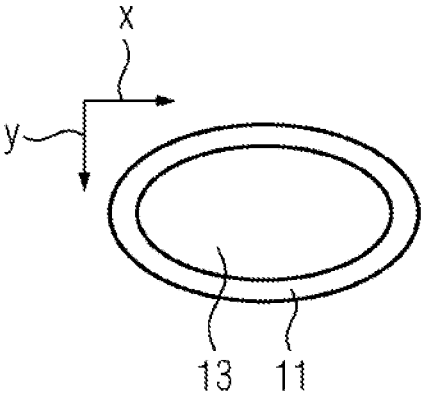
Figure 9:
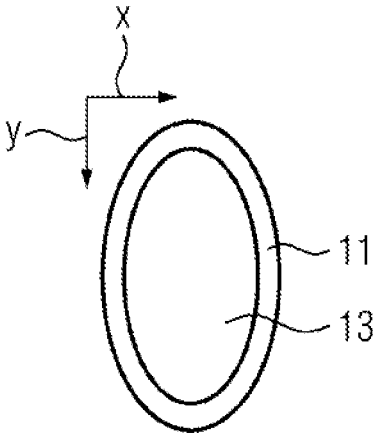

FIG. 5 shows the cross section 11 of the full jet 10 after exiting from the coolant outlet 8. In accordance with the illustration in FIG. 4, a spacing b of the cross-sectional plane 12, in which the cross section 11 is identified, may for example be between 20% and 80% of the spacing that the coolant outlet 8 has from the rolling stock 3, as seen in a jet direction r. In the present case, in accordance with the illustration in FIGS. 1 and 4, the jet direction r is orthogonal to the transport direction x and also orthogonal to the width direction y. However, this is not absolutely necessary. As per FIG. 5, the cross section 11 of the full jet 10 is indeed intrinsically continuous, but not convex. The associated convex envelope thus contains (at least) one region 13 which is contained in the convex envelope but not in the respective full jet 10 itself.

The convex envelope has—as seen in the cross-sectional plane 12—a maximum extent D. In the case of the configuration as per FIG. 5, this is the diameter of the convex envelope. The cross section 11 for its part has a maximum effective width d in the cross-sectional plane 12. The maximum effective width d of the cross section 11 can generally be defined as follows:

An arbitrary start point P1 at the periphery of the cross section 11 is selected, and a straight line L which enters the cross section 11 is drawn starting from the point P1. The end point P2 at which the line L exits from the cross section 11 again is ascertained. Next, the two angles $\beta 1$ and $\beta 2$ at which the line L enters the cross section and, respectively, exits from the cross section 11 at the start point P1 and at the end point P2 are ascertained. Each of the two angles $\beta 1$ and $\beta 2$ may be at most 90°. Next, the line L is rotated about the start point P1 until the end point P2 at which the sum of the two angles $\beta 1$ and $\beta 2$ is maximal has been found. The length of the then ascertained line L is the effective width for the start point P1. This effective width is, as it were, a "candidate" for the maximum effective width d. The start point P1 is then varied and the length of the respective effective width is ascertained for each start point P1. The respective "candidates" for the maximum effective width d are thus ascertained. The maximum of the ascertained effective widths is the sought maximum effective width d.

The maximum effective width d is always smaller than the maximum extent D. The ratio of the maximum extent D to the effective width d is preferably greater than 3:1, in particular greater than 5:1.

As per the illustration in FIG. 5, the cross section 11 is closed in an annular manner. As a result, the cross section 11 surrounds an individual intrinsically continuous region 13 which is enclosed, as seen in the cross-sectional plane 12, completely by the cross section 11. In this case, the effective width at any point P1 can be defined as follows:

The start point P1 is placed at the outer periphery of the cross section 11, that is to say on the periphery of the cross section 11 facing away from the region 13. Starting from the start point P1, the end point P2 at which the connecting line L with the start point P1 enters the region 13 at the end point P2 is sought. The end point P2 is then varied until the length of the connecting line L between the start point P1 and the end point P2 is minimal. The length of the line L ascertained in this way is the effective width for the start point P1. Varying the start point P1 thus allows the maximum effective width d to be ascertained as before.

In the specific case, the cross section 11 forms a circular ring. However, other annular (closed) cross sections are also possible, for example cross sections based on a square (alternatively for example a rectangle) or on ellipses or ovals in accordance with the illustrations in FIGS. 6 to 9.

Figure 10:
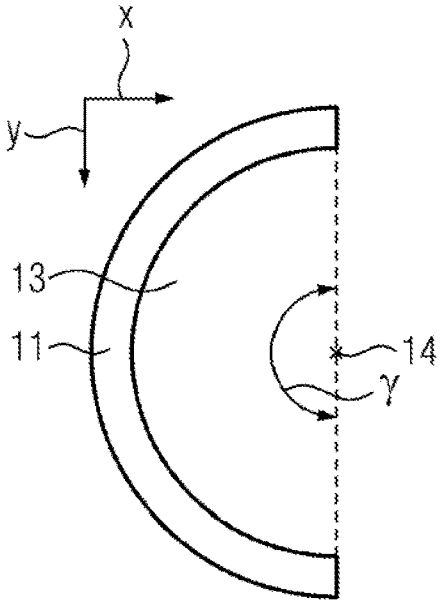

In accordance with the illustration in FIG. 10, it is furthermore also possible for the cross section 11 to be in the form of part of a circular ring. In this case, with regard to the center point 14 of the circular ring, the circular ring can extend for example over an extent angle $\gamma$ which is generally at least 90° and at most 270°. The extent angle $\alpha 2$ is usually between 120° and 240°, for example approximately 180°.

Figure 11:
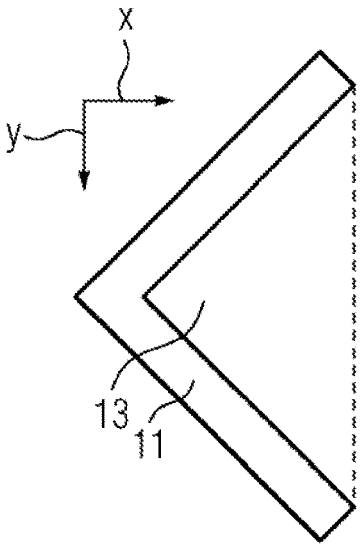
Figure 12:
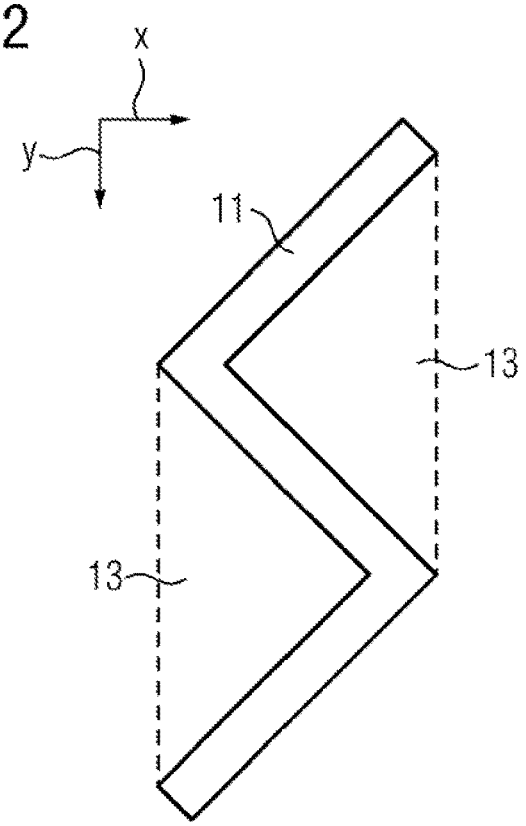
Figure 13:
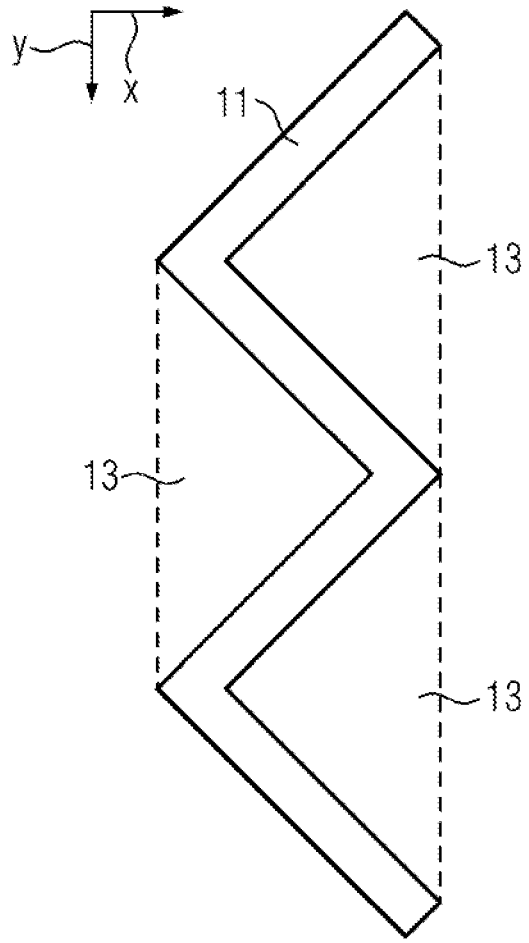

In accordance with the illustration in FIG. 11, it is furthermore also possible for the cross section 11 to be of V-shaped form. In accordance with the illustration in FIGS. 12 and 13, it is also possible for the cross section 11 to be of zigzag-shaped form. FIG. 12 shows this for an N shape, and FIG. 13 for a W shape.

Figure 14:
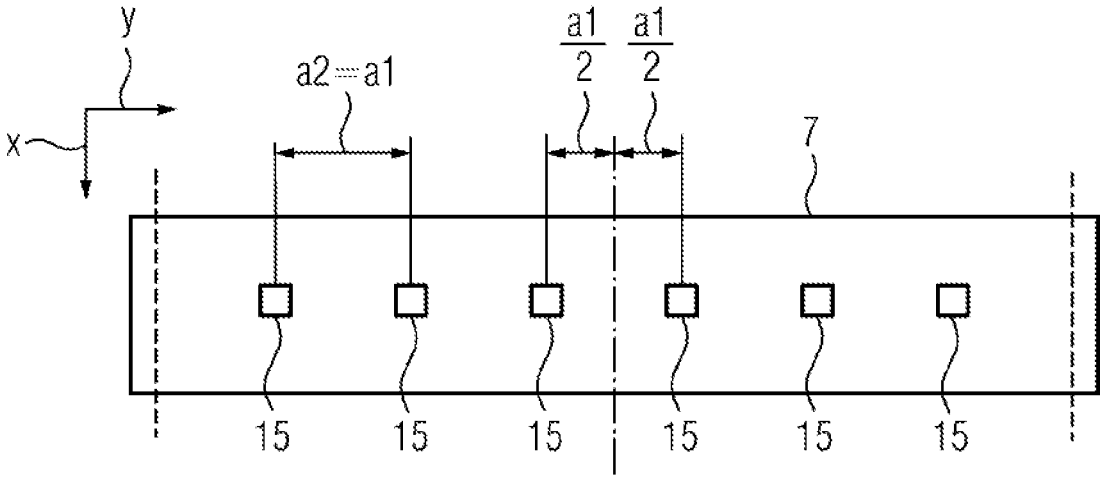
FIG. 14 shows that side of a second cooling bar which faces the rolling stock.

As per FIG. 14, the second cooling bars 7 also each comprise—analogously to the first cooling bar 6—a plurality of coolant outlets 15 facing the rolling stock 3. Water 9 is likewise applied to the rolling stock 3 by means of the coolant outlets 15 of the second cooling bars 7. However, the second cooling bars 7 are arranged, as seen in the transport direction x of the rolling stock 3, downstream of the first cooling bar 6. In the specific case, FIG. 14 illustrates the second cooling bar 7 that is arranged immediately downstream of the first cooling bar 6 as seen in the transport direction x of the rolling stock 3.

In the case of the second cooling bars 7, the coolant outlets 15 are also arranged in the respective cooling bar 7 in a positionally fixed manner. Analogously to the coolant outlets 8 of the first cooling bar 6, the coolant outlets 15 are arranged in a row or in multiple rows. In accordance with the illustration in FIG. 14, within the respective row, said coolant outlets have a respective predetermined spacing a2 from one another as seen in the width direction y of the rolling stock 3. The spacing a2 may correspond in particular to the spacing a1 by which the coolant outlets 8 of the first cooling bar 6 are spaced apart from one another as seen in the width direction y of the rolling stock 3.

The coolant outlets 15 of the second cooling bars 7 may be arranged as required. However, in particular in the case of the second cooling bar 7 illustrated in FIG. 14, that is to say the cooling bar 7 that is arranged immediately downstream of the first cooling bar 6 as seen in the transport direction x of the rolling stock 3, the coolant outlets 15 of the corresponding cooling bar 7 are preferably arranged, as seen in the width direction y of the rolling stock 3, between the coolant outlets 8 of the first cooling bar 6. It is apparent from FIG. 14 that, firstly, the spacing a2 corresponds to the spacing a1, and, secondly, the center line of the roller table, which is again illustrated by a dashed-and-dotted line in FIG. 14, is equidistantly spaced apart from the two directly adjacent coolant outlets 15, whereas, in the case of the first cooling bar 6, one of the coolant outlets 8 in that case lies on the center line of the roller table, in accordance with the illustration in FIG. 3.

The coolant outlets 15 of the second cooling bars 7 may be configured as required. Here, it is possible for all of the coolant outlets 15 of the second cooling bars 7 to have an identical configuration. However, it is also possible for the coolant outlets 15 of one of the second cooling bars 7 to be configured differently to the coolant outlets 15 of another of the second cooling bars 7. The following statements therefore relate in each case to an individual second cooling bar 7. Although this does not preclude the coolant outlets 15 of the other second cooling bars 7 from also having an identical configuration, it does not necessarily imply that the coolant outlets 15 of the other second cooling bars 7 have an identical configuration.

The coolant outlets 15 of one of the second cooling bars 7 may be configured in the same way as the coolant outlets 8 of the first cooling bar 6. Reference is made to the above statements concerning FIGS. 4 to 13. If the coolant outlets 15 of at least one of the second cooling bars 7 are configured in this way, these second cooling bars 7 generally comprise at least the second cooling bar 7 that is arranged immediately downstream of the first cooling bar 6 as seen in the transport direction x of the rolling stock 3.

Figure 15:
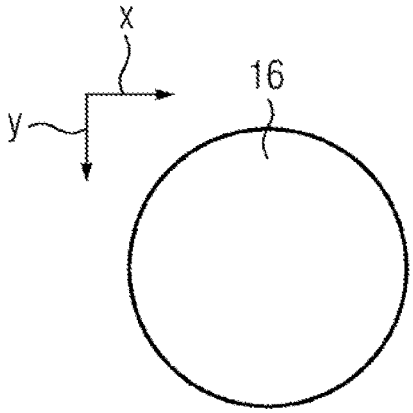
FIG. 15 shows a full jet in cross section.

It is also possible for the coolant outlets 15 of one of the second cooling bars 7 to indeed be—correspondingly to the coolant outlets 8 of the first cooling bar 6—in the form of full-jet nozzles, from which a full jet having a respective cross section exits during operation (see FIG. 4). However, in accordance with the illustration in FIG. 15, it is possible for the cross section 16 of the full jets of the coolant outlets 15 of the corresponding second cooling bar 7 to have, in contrast to the full jets of the coolant outlets 8 of the first cooling bar 6, a convex envelope which corresponds to the cross section 16 of the corresponding full jet.

Figure 16:
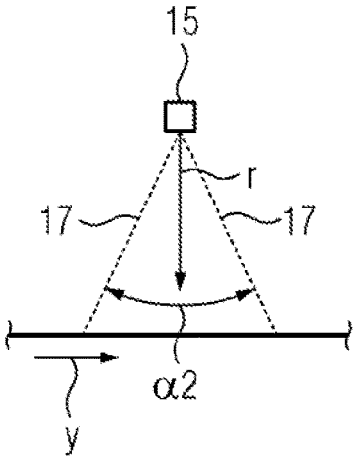
FIG. 16 shows a coolant outlet and a fan jet.
Figure 17:
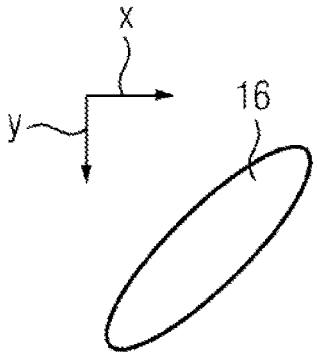
FIGS. 17 and 18 show possible cross sections of a fan jet.
Figure 18:
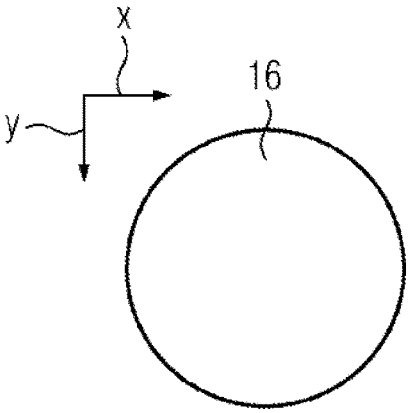

It is also possible for the coolant outlets 15 of one of the second cooling bars 7 to be in the form of fan nozzles. In this case, in accordance with the illustration in FIG. 16, the jets 17 dispensed by these coolant outlets 15 have a significant jet opening angle $\alpha 2$ in at least one direction. The jet opening angle $\alpha 2$ is often above 40°. Depending on the configuration of the corresponding coolant outlet 15, the spray pattern of the corresponding coolant outlet 15 may be either an elongate ellipse in accordance with the illustration in FIG. 17 or a circle in accordance with the illustration in FIG. 18. Orientation and rotation of the ellipses relative to the transport direction x and to the width direction y may be designed as required. However, the situation in which an ellipse is placed in an oblique position in accordance with the illustration in FIG. 17 should generally be preferred. Just like in the case of the full-jet nozzles, however, the jet direction r does not have to be oriented orthogonally with respect to the plane defined by the transport direction x and the width direction y.

Figure 19:
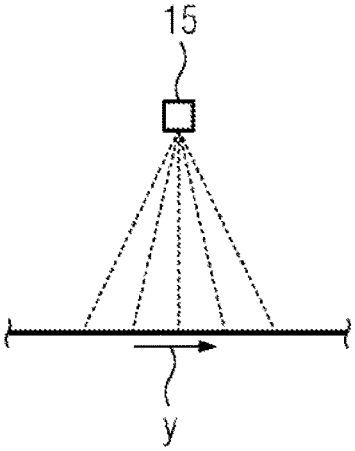
FIG. 19 shows a coolant outlet and a spray pattern.
Figure 20:
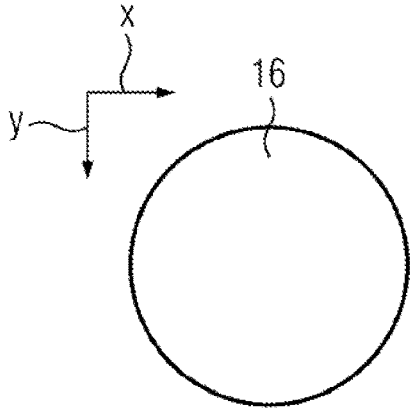
FIG. 20 shows a spray pattern.

It is also possible for the coolant outlets 15 of one of the second cooling bars 7 to be in the form of spray nozzles in accordance with the illustration in FIG. 19. In this case, a circular spray pattern is produced in accordance with the illustration in FIG. 20, but with the water 9 no longer being sprayed directly onto the rolling stock 3 in accordance with the illustration in FIG. 19, that is to say no longer impinging on the rolling stock 3 at a significant speed directed toward the rolling stock 3.

If one of the second cooling bars 7 comprises fan nozzles or spray nozzles as coolant outlets 15, this second cooling bar 7 does not necessarily have to be, but preferably is, a second cooling bar 7 that is not arranged immediately downstream of the first cooling bar 6.

It is possible for the first cooling bar 6 to be in the form of an intensive cooling bar. The same configuration is also possible for the second cooling bars 7, provided that they comprise full-jet nozzles. In this case, the water 9 exits from the coolant outlets 8, 15 of the corresponding cooling bars 6, 7 with a pressure p1 of at least 1 bar. The pressure p1 is usually between 1.5 bar and 4 bar.

Alternatively, it is possible for the first cooling bar 6 to be in the form of a laminar cooling bar. The same configuration is also possible for the second cooling bars 7, provided that they comprise full-jet nozzles. In this case, the water 9 exits from the coolant outlets 8, 15 of the corresponding cooling bars 6, 7 with a pressure p2 of at most 0.5 bar. The pressure p2 is usually between 0.1 bar and 0.4 bar. Although the water 9 can be supplied with a higher pressure to the second cooling bars 7 comprising fan nozzles or spray nozzles, the fact that the coolant outlets 15 are designed as fan nozzles or spray nozzles means laminar cooling is always effected in the case of these second cooling bars 7.

The present invention has many advantages. In particular, the non-convex, often "hollow" configuration of the cross section of the full jets 10 of the first cooling bar 6 and possibly also of further cooling bars 7 has the effect that the size of the impingement region in which the respective full jet 10 impinges on the rolling stock 3 can be increased considerably. The irregularities in the cooling of the rolling stock 3 can be reduced as a result. However, the rest of the advantages of full jets 10 remain unchanged.

Although the invention has been illustrated and described in more detail by the preferred exemplary embodiment, the invention is not limited by the examples disclosed, and other variants can be derived therefrom by a person skilled in the art without departing from the scope of protection of the invention.

LIST OF REFERENCE DESIGNATIONS

1 Finishing train
2 Rolling stands
3 Rolling stock
4 Cooling devices
5 Rollers
6, 7 Cooling bars
8, 15 Coolant outlets
9 Water
10 Full jet
11, 16 Cross sections
12 Cross-sectional plane
13 Region
14 Center point
17 Jets
a1, a2 Spacing of coolant outlet to coolant outlet
b Spacing of cross-sectional plane to coolant outlet
d Effective width
D Maximum extent
L Straight line
p1, p2 Pressures
P1 Start point
P2 End point
r Jet direction
x Transport direction
y Width direction
$\alpha$1, $\alpha$2 Jet opening angle
$\beta$1, $\beta$2 Angle
$\gamma$ Extent angle

The invention claimed is:

1. A treatment line for a flat, elongate hot metal rolling stock, comprising:
- a finishing train for rolling the rolling stock; and
- a cooling device,
- wherein the cooling device is arranged upstream of the finishing train, is arranged downstream of the finishing train, or is arranged within the finishing train,
- wherein the cooling device comprises a first cooling bar which extends, as seen in a width direction (y) of the rolling stock, completely over the rolling stock,
- wherein the first cooling bar comprises a plurality of first coolant outlets facing the rolling stock, by means of which water is applied to the rolling stock,
- wherein the first coolant outlets are arranged in the first cooling bar so as to be positionally fixed in at least one row extending in the width direction (y) of the rolling stock, and have, within the respective row, a respective predetermined spacing (a1) from one another,
- wherein the first coolant outlets are full-jet nozzles, from which a full jet having a respective intrinsically continuous cross section exits during operation,
- wherein a jet opening angle of the full jet exiting from the full-jet nozzles is at most 5°,
- wherein the cross sections of the full jets each have a convex envelope, and
  - the respective convex envelope contains at least one region, which is not contained in the respective full jet itself.

2. The treatment line as claimed in claim 1, wherein the first cooling bar is an intensive cooling bar, with the result that the water exits from the first coolant outlets with a pressure (p1) of at least 1 bar.

3. The treatment line as claimed in claim 1, wherein the first cooling bar is a laminar cooling bar, with the result that the water exits from the first coolant outlets with a pressure (p2) of at most 0.5 bar.

4. The treatment line as claimed in claim 1, wherein the cross sections of the full jets are each closed in an annular manner.

5. The treatment line as claimed in claim 1, wherein the cross sections of the full jets are each a part of a respective circular ring.

6. The treatment line as claimed in claim 1, wherein the cross sections of the full jets are each of V-shaped or zigzag-shaped form.

7. The treatment line as claimed in claim 1, wherein
- the respective convex envelope has, as seen in the cross-sectional plane, a maximum extent (D),
- the respective cross section has, as seen in the cross-sectional plane, a maximum effective width (d), and
- the ratio of the maximum extent (D) to the maximum effective width (d) is greater than 3:1.

8. The treatment line as claimed in claim 1, wherein
- the cooling device comprises at least one second cooling bar,
- the second cooling bars extend, as seen in the width direction (y) of the rolling stock, completely over the rolling stock and each have a plurality of second coolant outlets facing the rolling stock, by means of which water is applied to the rolling stock,
- the second coolant outlets are arranged in the second cooling bar so as to be positionally fixed in at least one row extending in the width direction (y) of the rolling stock,
- the second coolant outlets have, within the respective row, a respective predetermined spacing (a1) from one another, and
- the second cooling bars are arranged, as seen in a transport direction (x) of the rolling stock, downstream of the first cooling bar.

9. The treatment line as claimed in claim 8, wherein the second coolant outlets of at least one of the second cooling bars are arranged, as seen in the width direction (y) of the rolling stock, between the first coolant outlets of the first cooling bar.

10. The treatment line as claimed in claim 8, wherein
- the second coolant outlets of at least one of the second cooling bars are full-jet nozzles, from which a full jet having a respective cross section exits during operation,
- the cross sections of these full jets each have a convex envelope, and
- this respective convex envelope contains at least one region which is not contained in the respective full jet itself.

11. The treatment line as claimed in claim 8, wherein
- the second coolant outlets of at least one of the second cooling bars are full-jet nozzles, from which a full jet having a respective cross section exits during operation,
- the cross sections of these full jets each have a convex envelope, and
- this respective convex envelope corresponds to the cross section of the respective full jet.

12. The treatment line as claimed in claim 8, wherein the second coolant outlets of at least one of the second cooling bars are fan nozzles or spray nozzles.

13. A method for finish-rolling and cooling a flat, elongate metal rolling stock in a treatment line as claimed in claim 1, comprising the following method steps:

hot rolling the rolling stock in the finishing train of the treatment line;

cooling the at least partially hot-rolled rolling stock in the cooling device of the treatment line, wherein water is used to cool the rolling stock, in the width direction thereof, by way of a plurality of full jets, wherein at least some of the plurality of full jets contain a respective convex envelope comprising at least one region which is not contained in the respective full jet itself.

14. The method as claimed in claim 13, wherein the rolling stock is wound up into a coil after cooling.

15. The treatment line as claimed in claim 1, wherein the first cooling bar is an intensive cooling bar, with the result that the water exits from the first coolant outlets with a pressure (p1) of between 1.5 bar and 4 bar.

16. The treatment line as claimed in claim 1, wherein the first cooling bar is a laminar cooling bar, with the result that the water exits from the first coolant outlets with a pressure (p2) of between 0.1 bar and 0.4 bar.

17. The treatment line as claimed in claim 1, wherein in that the respective convex envelope has, as seen in the cross-sectional plane, a maximum extent (D), in that the respective cross section has, as seen in the cross-sectional plane, a maximum effective width (d), and in that the ratio of the maximum extent (D) to the maximum effective width (d) is greater than 5:1.

18. The method as claimed in claim 13, wherein all of the plurality of full jets contain a respective convex envelope comprising at least one region which is not contained in the respective full jet itself.

* * * * *